US006918487B2

(12) United States Patent
Harrelson

(10) Patent No.: US 6,918,487 B2
(45) Date of Patent: Jul. 19, 2005

(54) DISPENSING SYSTEM FOR DOUBLE STACK CARTON

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 110 days.

(21) Appl. No.: 10/365,148

(22) Filed: Feb. 12, 2003

(65) Prior Publication Data

US 2004/0154945 A1 Aug. 12, 2004

(51) Int. Cl.[7] ..... B65D 75/00; B65D 17/00; A47F 1/04

(52) U.S. Cl. ..... 206/427; 221/305; 229/122; 229/242

(58) Field of Search ..... 206/427, 428–429; 221/305; 229/121–122, 235, 240, 242, 244

(56) References Cited

U.S. PATENT DOCUMENTS 3,265,283 A * 8/1966 Farquhar ..... 206/427
3,356,279 A * 12/1967 Root ..... 206/427
4,318,474 A * 3/1982 Hasegawa ..... 206/428
4,331,289 A * 5/1982 Killy ..... 229/117.13
4,364,509 A * 12/1982 Holley, et al. ..... 221/305
4,396,143 A * 8/1983 Killy ..... 221/305
4,498,581 A * 2/1985 Dutcher ..... 206/427
4,577,799 A * 3/1986 Oliff ..... 229/198.2
5,505,372 A * 4/1996 Edson et al. ..... 229/121
6,478,219 B1 * 11/2002 Holley, Jr. ..... 229/240
6,578,736 B2 * 6/2003 Spivey ..... 221/305
6,669,083 B2 * 12/2003 Bates ..... 229/240
6,715,639 B2 * 4/2004 Spivey ..... 221/305

* cited by examiner

*Primary Examiner*—Bryon P. Gehman
(74) *Attorney, Agent, or Firm*—Womble Carlyle Sandridge & Rice, PLLC

(57) ABSTRACT

The carton of this invention is capable of carrying the plurality of containers stacked upon their ends in two tiers with a unique dispenser that permits the dispensing of containers on their sides. The dispenser is formed in a top side wall and extends into the end wall with most of the end wall being torn open but leaving a portion near the bottom side wall to prevent the bottom layer of containers from rolling out. Angled projections in the dispensing end of the carton near the top panel and bottom panel prevent the top layer of containers from rolling out. A divider may be inserted between the two tiers of containers to facilitate loading the carton and preventing the containers from accidentally rolling out when the dispenser is open.

33 Claims, 4 Drawing Sheets

DISPENSING SYSTEM FOR DOUBLE STACK CARTON

BACKGROUND OF THE INVENTION

1. Field of the Invention

The present invention relates generally to an enclosed paperboard carton capable of enclosing containers in two tiers, which carton has a unique opening and dispensing feature that allows the containers, for example, cans, to be removed or dispensed one container per tier at a time without destroying the overall structural integrity of the carton. The unique opening and dispensing feature can be incorporated in cartons containing a plurality of layers of containers stacked on end and still limit the dispensing to one container per tier at a time.

2. Background

Fully enclosed cartons capable of enclosing cans have been used in the past that have a feature for dispensing the cans one at a time. Dispensers have been provided at various locations on these cartons depending on the design.

Cartons have been introduced into the marketplace that can carry 24 or more containers, for example cans, in two stacks or tiers. So far no satisfactory dispenser has been developed for dispensing the layers of cans in these two stack cartons one at a time from each stack or tier. Consequently, when these cartons are opened they tend to let a number of the cans roll out which has not allowed these twin stack cartons to achieve their full potential.

3. Prior Art

U.S. Pat. No. 3,265,293 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened. It will be realized that the design of this dispenser is not satisfactory for dispensing containers, for example cans, that are stacked in twin stacks in a carton.

U.S. Pat. No. 4,364,509 to Holly, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the existing can. The dispenser of this carton is not satisfactory for use in a twin stack carton for carrying containers.

SUMMARY OF THE INVENTION

It is an object of this invention to develop a dispenser for dispensing containers, for example cans, one at a time from a carton containing containers in two stacks or tiers. It is the further object of this invention to develop a dispenser that can be easily opened. A further object of this invention is to develop a dispenser that can be used for containers stacked in a 3 by 4 configuration in each stack to be dispensed one at a time from each stack without the containers rolling out accidentally. A final object of this invention is to develop a dispenser for a twin stack carton that does not destroy the structural integrity of the carton when it is opened.

Briefly described, in its preferred form, the objects of this invention are achieved by providing an enclosed carton for carrying containers in two tiers for dispensing the containers one at a time from each tier from the exiting end of the carton. The carton is generally rectangular and has a bottom, top, two sides, a closed end and exiting end. The carton is foldably constructed from a blank having panels and flaps. The carton is designed to carry containers, e.g. cans, that are stacked on their ends in two tiers from the bottom panel to the top panel. The dispenser is constructed by providing tear lines in one of the side panels that extend into the exiting end of the carton which is rested on the other side panel, with the dispenser being capable of dispensing the containers as they are resting on their sides. A tear line is provided in the end of the carton placed from the side upon which the carton rests while dispensing containers at a sufficient distance to prevent any of the containers below the top layer of containers from rolling out of the carton when the dispenser is open. A pair of tear lines extend from this bottom tear line from each end at an angle from the bottom tear line to the top side panel in which part of the dispenser is formed. The angle and distance of the projection is such as to restrain the top layer of cans in each tier from accidentally rolling out. The dispenser is constructed with a large enough opening in the top side panel in which it is formed to permit a person to grasp and remove a container in each tier one at a time.

This carton can be designed with a dispenser dispensing containers in a 3 by 4 configuration in each tier. The bottom tear line is located so as to prevent the bottom layers of containers from rolling out of the carton. A pair of tear lines extending from the ends of the bottom tear line are placed at an angle designed to restrain containers in the top layer from rolling out of the carton.

Because a carton for carrying 24 containers is placed under a great deal of stress, the top panel can be constructed from two handle flaps having a reinforcing strip attached to the inside handle flap folded over against the inside of the carton between the two oval handle apertures carrying the carton.

To facilitate holding the containers and dispensing them one at a time a divider may be provided between each tier of containers.

To facilitate opening the carton dispenser, a pull tab can be provided in the side panel where part of the dispenser is located, with the pull tab being loosely attached to the panel, but tightly attached to the dispenser for opening the dispenser.

Preferably the exiting end of the carton has four flaps for closing this end. An end flap attached to the side of the carton on which it is resting while the containers are being dispensed is generally not removed and serves to restrain one or more of the bottom layers of containers from rolling out of the carton. Preferably the tear lines in the end flaps attached to the top panel, and bottom panel are constructed so that a portion of each of these flaps is not removed and are glued to the flap attached to the side panel on which the carton rests during dispensing to preserve the integrity of the carton.

Other objects, features and advantages of this invention will become apparent upon reading the following specification, when taken in conjunction with the accompanying drawings.

DETAILED DESCRIPTION OF THE PREFERRED EMBODIMENTS

Figure 1:
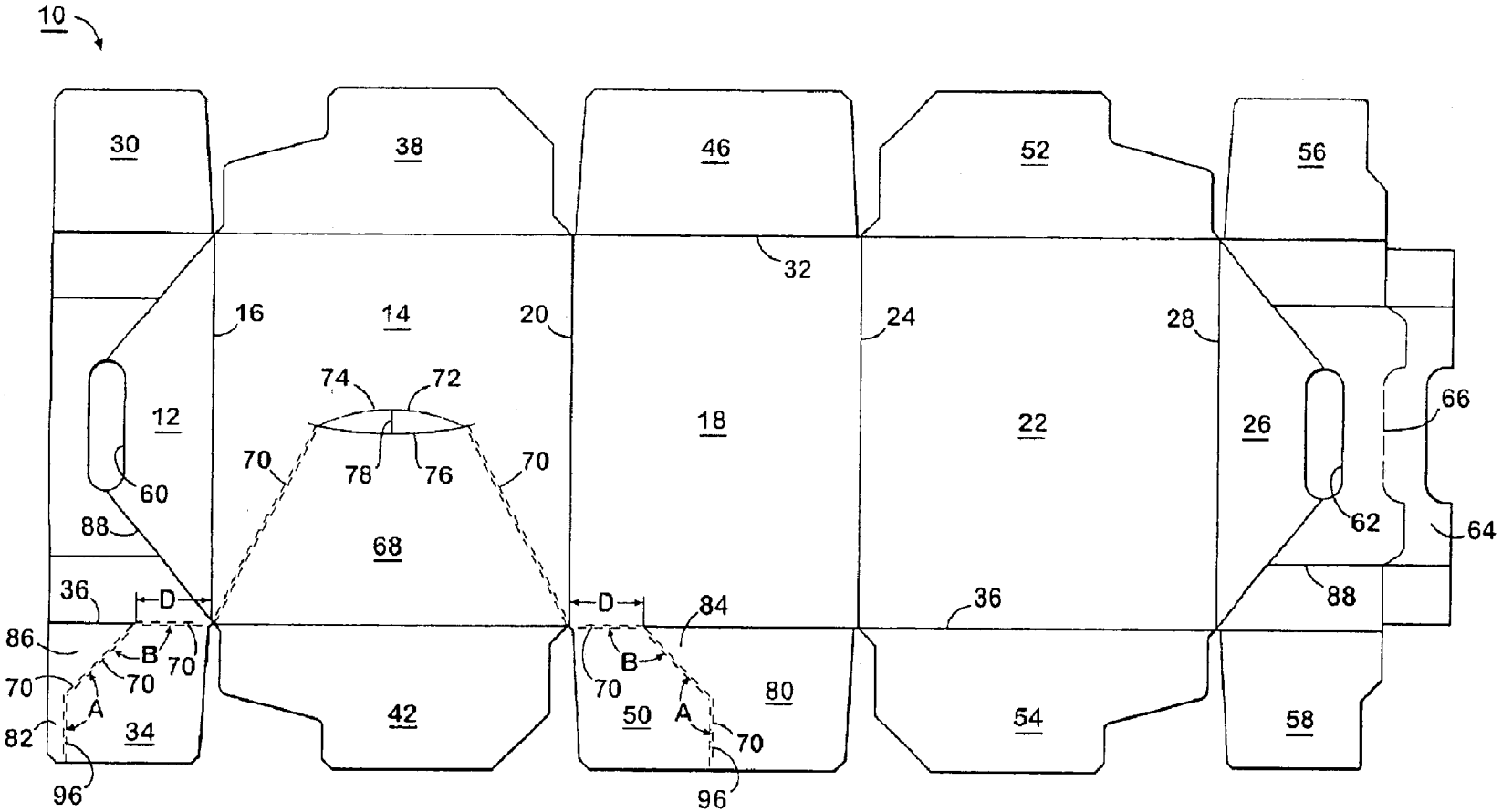
FIG. 1 is a plan view of the blank of the preferred embodiment of this invention from which a carton is formed.

The present invention is intended primarily for use with cans of the types used to contain soft drinks, beer and the like. The blank 10 is formed from a foldable sheet of material, such a paperboard. The blank 10 has an outside handle flap 12 which is attached to the top side panel 14 by fold line 16 which in turn is attached to bottom panel 18 by fold line 20, which in turn is attached to bottom side panel 22 by fold line 24. Bottom side panel 22 is foldably attached to inside handle flap 26 by fold line 28. The carton is supplied with a number of end flaps for closing the ends of the carton. The outside handle flap 12 is attached to outside top end flap 30 by fold line 32 and outside handle flap 12 is attached to outside top end flap 34 by fold line 36. Top side flap 38 is attached to top side panel 14 by fold line 32. Top side panel 14 is attached to top side flap 42 by fold line 36. Bottom panel 18 is attached to bottom end flap 46 by fold line 32 and to bottom end flap 50 by fold line 36. Bottom side panel 22 is attached to bottom side flap 52 by fold line 32 and to bottom side flap 54 by fold line 36. Inside handle flap 26 is attached to inside top end flap 56 by fold line 32 and to the inside top end flap 58 by fold line 36.

This carton has a pair of race track handles 60 and 62 formed in outside handle flap 12 and inside handle flap 26 respectively. Because this carton is designed to carry 24 containers, such as cans, it is provided with a handle reinforcing flap 64 attached to inside handle flap 26 by fold line 66.

A dispensing flap 68 is partially formed in top side panel 14 by tear line 70. To facilitate opening this dispenser, a pull tab 72 is provided to facilitate opening the dispensing flap 68. The pull tab 72 is loosely attached to top side panel 14. Pull tab 72 has a slit 74 between it and top side panel 14 to ease pulling of the pull tab from the plane of top side panel 14. Pull tab 72 is attached to dispensing flap 68 by fold line 76. A slit 78 may be provided in the middle of pull tab 72 to ease its removal from top side panel 14.

I will be understood by those skilled in the art that the carton of the present invention is generally symmetrical about a horizontal line of bisection, as viewed when FIG. 1 is rotated lengthwise. This symmetry aids in the efficient production of the present carton.

Figure 7:
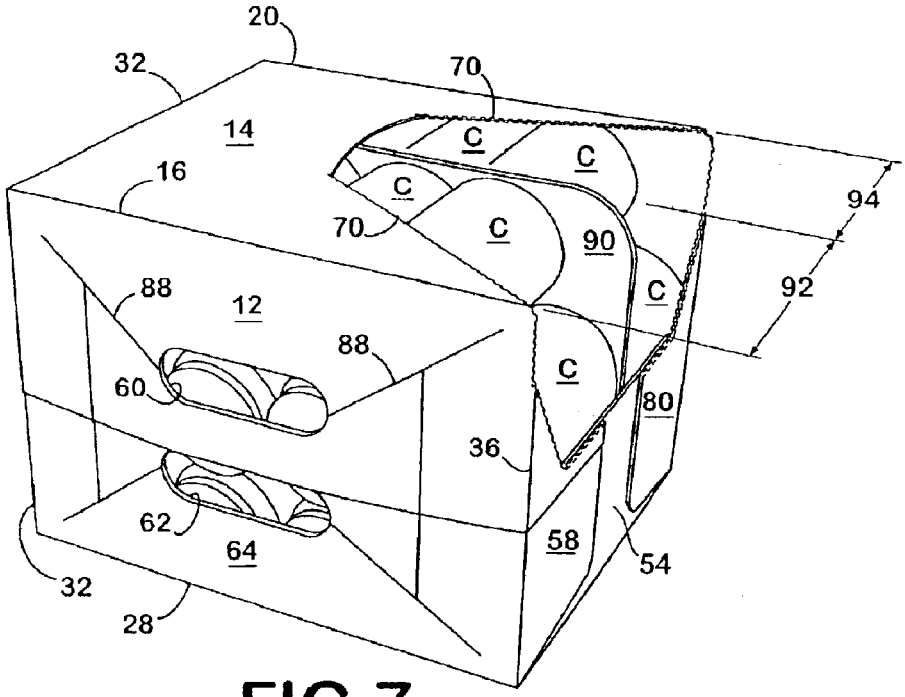
FIG. 7 is a perspective end view of the carton of FIG. 6 showing that a can has been removed from the top tier and from the bottom tier of cans.

In forming this blank 10 into a carton, the handle reinforcing flap 64 is folded along fold line 66 and glued to the inside handle flap 26. The blank 10 is then folded so that outside handle flap 12 is glued to inside handle flap 26 so that the two oval handles 60 and 62 are parallel to each other. These steps result in forming a carton sleeve in which cans can be loaded in the bottling plant. The cans can be placed in two tiers of a 3 by 4 configuration. This is best illustrated in FIG. 7 which shows the top tier 92 located near the top of the carton and the bottom tier 94 located near the bottom of the carton. In order to maintain the two tiers of cans in proper alignment during loading and when dispensed to the consumer, a divider 90 may be necessary. The divider 90 can be made out of a single sheet of paperboard.

After the two tiers of cans have been loaded into the carton various end flaps on both ends are closed and glued. To use the end of the carton where the dispenser is located as an example, the top side flap 42 is folded inwardly, bottom side flap 54 is folded inwardly, bottom end flap 50 is folded in an overlapping position, and glued to top side flap 42 and bottom side flap 54. Outside top end flap 34 and inside top end flap 58 are glued together to form a single top end flap which is likewise glued to top side flap 42 and bottom side flap 54. The other end of the carton is closed in the same manner.

When the dispenser is opened, dispensing flap 68, which includes top side flap 42, is removed from the carton along with a portion of outside end flap 34 and bottom end flap 50 along tear line 70. In order to preserve the structural integrity of the carton after the dispenser has been opened, it is important that end retention panel 82 be glued to inside top end flap 58 which in turn is glued to bottom side flap 54. Otherwise, the end retention projection 86 will not be firmly attached to carton. It is likewise important that end retention panel 80 be glued to bottom side flap 54 in order to ensure that end retention projection 84 is firmly attached to the carton after the dispenser is opened.

It should be realized that dispensers could be placed on both ends of the carton, but preferably it is only placed on one end. Cans can be removed from the exiting end of the carton after tear line 70 has been torn. The pair of tear lines 70 converge towards each other towards pull tab 72. Tear line 70 extends along fold line 36 between bottom end flap 50 and bottom panel 18 for a distance D and turns at an angle B and turns again at angle A to form a portion of bottom tear line 96. On the other side of top side panel 14, tear line 70 extends to fold line 36 and extends along that line and turns into the interior of outside top end flap 34 at angle B until it turns to form bottom line 96 at angle A.

Figure 2:
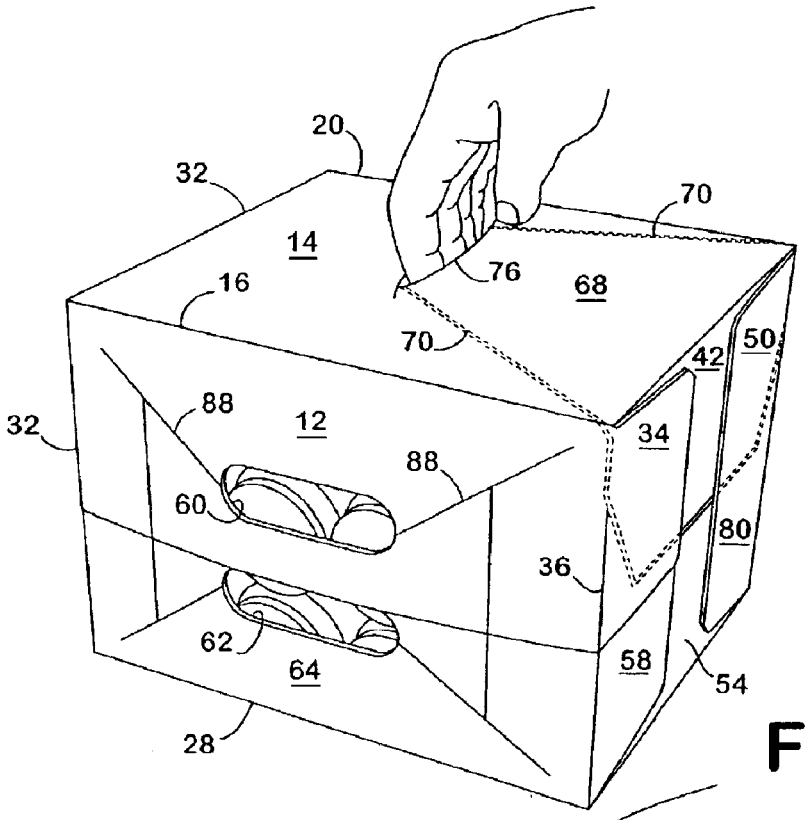
FIG. 2 is a perspective top view of the carton of the preferred embodiment loaded with two tiers of cans in a 3 by 4 configuration in each tier with a person starting to open the dispenser.
Figure 3:
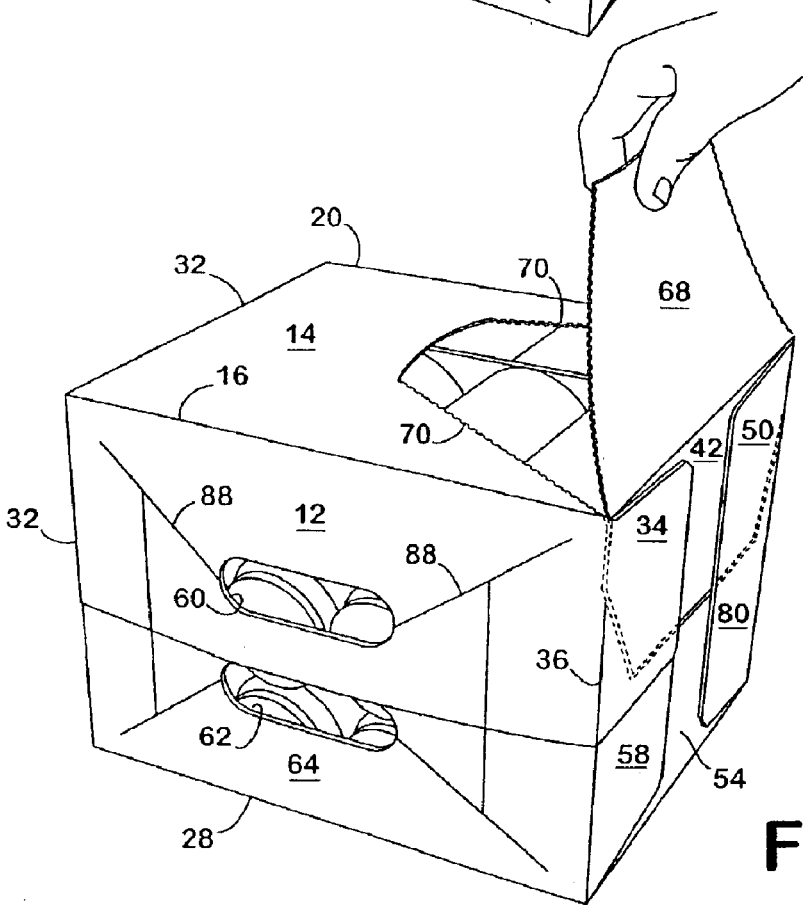
FIG. 3 is a perspective top view of the carton with a dispenser pulled part way open.
Figure 4:
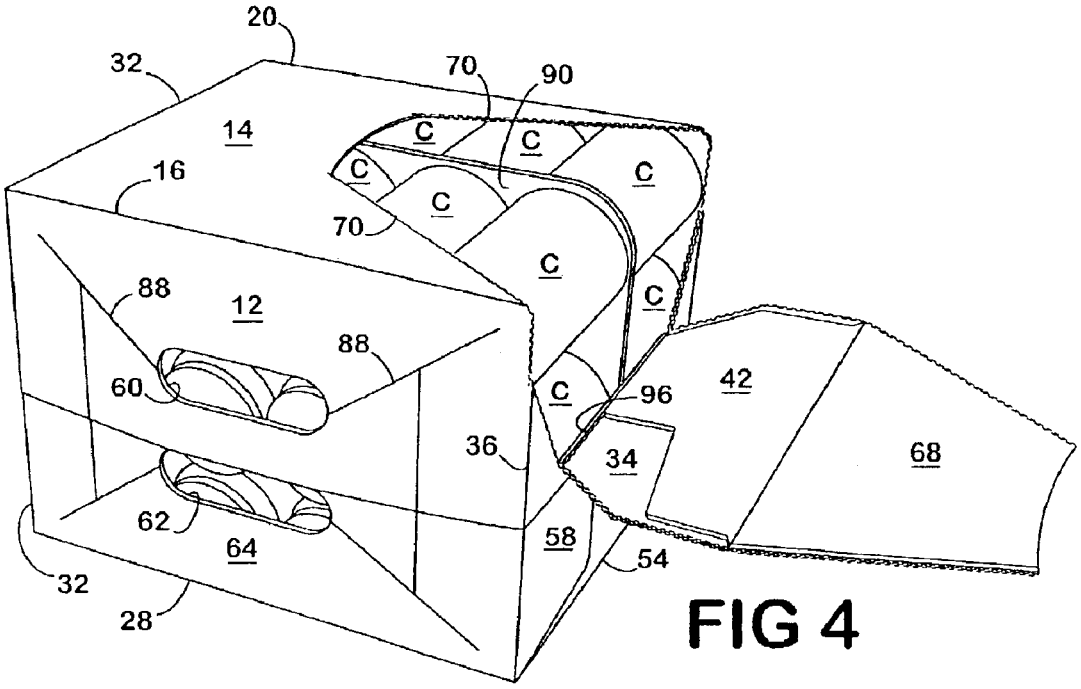
FIG. 4 is a perspective end view of the carton with cans in each tier in a 3 by 4 configuration with the dispenser being opened except for the bottom tear line.
Figure 5:
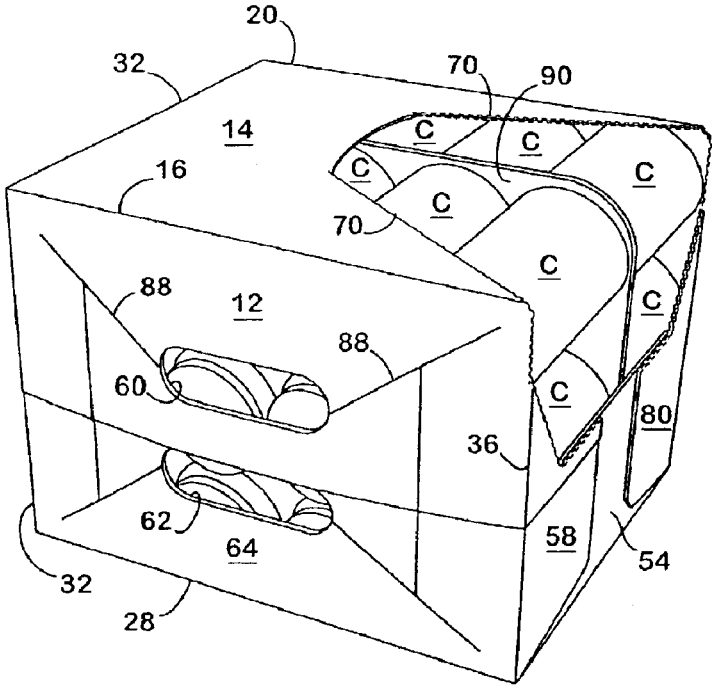
FIG. 5 is perspective end view of the carton loaded with two tiers of cans in a 3 by 4 configuration with the dispenser completely removed but all the cans being contained in the carton.

The consumer can open dispensing flap 68 by inserting his or her fingers into pull tab 72 which is an easy maneuver because of slit 74. In place of slit 74, a tear line that is loosely attached to top side panel 14 may be substituted in lieu of the slit. Insertion of the fingers into the aperture formed by depressing pull tab 72 is illustrated in FIG. 2. It will be noticed that the carton has been turned 90° so that it rests on bottom side panel 22. Outside handle flap 12 and inside handle flap 26 form the top panel. The consumer precedes to pull pull tab 72 upward which is connected by fold line 76 to dispensing flap 68 which is pulled up as illustrated in FIG. 3. Continued tearing open of the dispenser is illustrated in FIG. 4. The dispenser is opened along tear line 70 which extends on both sides so that the dispensing flap 68 is torn open along fold line 36 and into the interior of outside top end flap 34 and bottom end flap 50 as illustrated in FIG. 4. The tearing continues down to the point where tear line 70 forms bottom tear line 96 which has not yet been torn as shown in FIG. 4. FIG. 5 illustrates a complete removal of the dispenser by tearing along bottom tear line 96. Even though the entire dispenser has been removed in FIG. 5, the cans are retained in the carton even though the cans are lying on their sides. The bottom two layers of cans in the 3 by 4 configuration are prevented from rolling out of the carton by bottom side flap 54 to which end retention panels 80 and 82 are glued. It will be noticed that bottom side flap 54 only extends part way up the diameter of the cans in the second layer of the three tiers. The top layer of cans in the two tiers is prevented from rolling out by end retention projections 84 and 86. Tear line 70 only extends along fold line 36 a distance D which is slightly less than the diameter of the top layer of cans being contained. This is sufficient to prevent the top layer of cans from rolling out of the carton but yet not prevent an obstacle to their easy removal by the consumer. Tear line 70 turns at an angle B and then turns again at angle A to form the bottom tear line 96 on both outside top end flap 34 and bottom end flap 50. It will be realized that end retention projections 84 and 86 are helpful in retaining the top layer of cans in the carton. The extent of this help depends upon the location of the bottom tear line 96 in relation to the layers of cans C.

Figure 6:
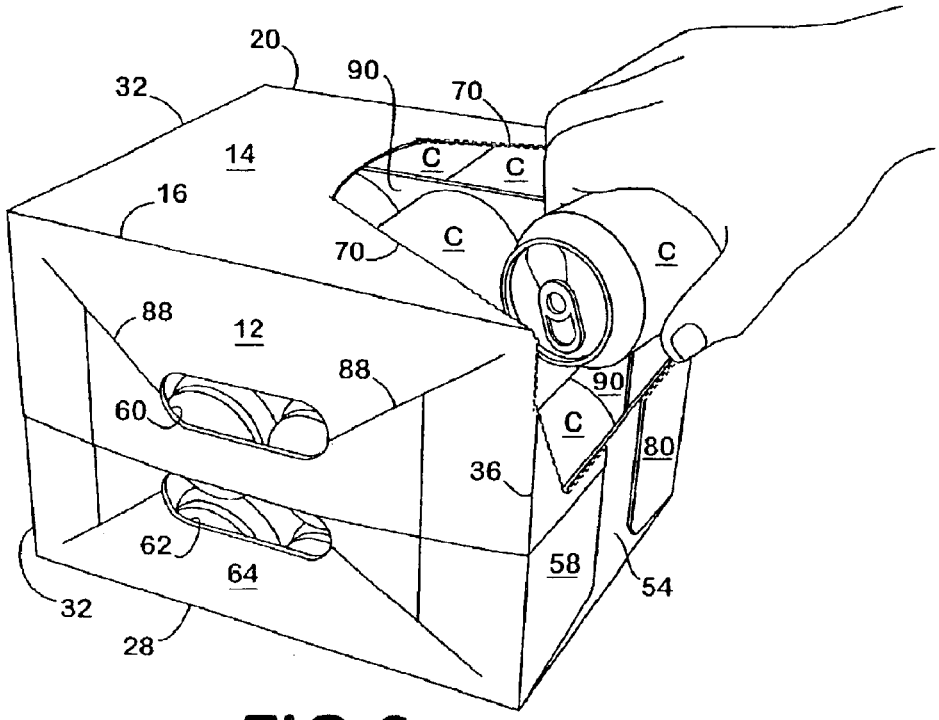
FIG. 6 is a perspective end of the carton of FIG. 5 showing a person removing a can from the top tier of cans.

FIG. 6 illustrates a consumer removing a can from the top tier 92 of cans C. It will be noticed that the consumer moves a can by twisting it slightly along its longitudinal axis and removing the bottom end of the can C first as it easily slides along the divider 90. It is necessary to remove the can in this way as the top of the can is retained in position by end retention projection 86. The end retention projections 84 and 86 are important as it is desirable that the cans in the top layer not roll out when the dispenser is open. The divider 90 and end retention projections 84 and 86 are designed to ensure that the top layer of cans adjacent the dispenser not roll out accidentally. FIG. 7 illustrates a carton with cans from each tier having been removed with the remaining cans held in place.

Because the blank 10 is designed to carry 24 cans in two tiers, it will be appreciated that the carton is heavy when loaded with cans. It is preferred that the top panel be composed of an outside handle flap 12 and an inside handle flap 26 and handle reinforcing flap 64 be utilized. In addition, stress lines 88 that are designed to dissipate the stress posed by lifting the carton handle 60 and 62 can be utilized. It should be realized that the carton sleeves can be glued together at other locations but is preferred to be glued at the top panel.

It will be noticed that the tear lines 70 in top side panel 14 converge towards each other and extend away from fold line 36 to provide a large enough opening when dispensing flap 68 is removed to permit a person to grasp cans in the top layer in each tier near the exiting end of the carton.

A carton for carrying cans is preferred that these containers have ends that are of the same diameter as the body of the container.

Unique Features of the Dispenser of this Invention

One of the unique features of the dispenser of this invention is that is permits the easy dispensing of containers that are stacked in two tiers. The carton is unique in that it carries the containers in their upright position, but dispenses them when the containers are on their side. Placement of the bottom tear line in the dispenser will restrain all but the top layer of containers from rolling out. An angled projection on each side of the dispenser can be utilized to prevent the top layer of containers from rolling out. The provision of a divider is important in maintaining the configuration of the containers into two tiers during loading and dispensing.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton for carrying a plurality of containers, comprising:

a generally rectangular bottom panel;

a top panel;

a generally rectangular bottom side panel adjacent the bottom panel and the top panel;

a generally rectangular top side panel adjacent the bottom panel and the top panel;

a bottom end flap extending across at least a part of an exiting end of the carton;

at least one top end flap extending across at least a part of the exiting end;

at least one flap extending across an end of the carton opposite to the exiting end;

a first tear line extending across the top side panel;

a second tear line extending across the top side panel, wherein the first and second tear lines define part of a dispensing flap; and a plurality of tear lines extending across the exiting end and further defining the dispensing flap, the plurality of tear lines including a third tear line extending along and collinear with a first fold line connecting the bottom panel and the bottom end flap.

2. The carton of claim 1, wherein the plurality of tear lines comprise:

a fourth tear line extending from the third tear line obliquely to the first fold line.

3. The carton of claim 2, wherein the first and second tear lines converge at a slit in the top side panel.

4. The carton of claim 2, wherein the plurality of tear lines comprise:

a bottom tear line extending from the fourth tear line across the exiting end.

5. The carton of claim 4, wherein the top panel comprises a handle flap connected to the top side panel at a second fold line, wherein the at least one top end flap is connected to the handle flap at a third fold line, and wherein a fifth tear line extends along and collinear with the third fold line.

6. The carton of claim 5, wherein the at least one top end flap comprises an outside top end flap and an inside top end flap that partially overlaps the outside top end flap.

7. The carton of claim 5, comprising:

a sixth tear line extending from the fifth tear line obliquely to the second fold line, wherein the bottom tear line extends from the sixth tear line, and wherein the bottom tear line includes a portion that is essentially perpendicular to the third fold line.

8. The carton of claim 7, wherein:

the fourth tear line extends at an angle from the first fold line and the sixth tear line extends at substantially the same angle from the third fold line; and the third tear line has substantially the same length as the fifth tear line.

9. The carton of clam 7, wherein the plurality of tear lines are continuous with one another.

10. The carton of claim 4, wherein the top panel comprises:

an outside handle flap;

an inside handle flap; and at least one race track handle.

11. The carton of claim 10, comprising:

a bottom side flap foldably attached to the bottom side panel and extending across the exiting end.

12. The carton of claim 4, wherein the plurality of tear lines are continuous with one another.

13. The carton of claim 4, comprising:

a divider extending parallel with the bottom panel.

14. In combination, a carton according to claim 2 and a plurality of containers arranged in two tiers, wherein:

each tier comprises twelve containers in a four container by three container arrangement;

each container has an axis, the container axes being aligned generally parallel to the top side panel; and the dispensing flap, when removed, allows access to the containers in both tiers.

15. An enclosed paperboard carton and twenty-four containers, each container having two ends and an axis between the ends, wherein the containers are stacked in the carton in two tiers, each tier having twelve of the containers arranged in a three by four configuration, the carton comprising:

a. a bottom panel, wherein the axes of the containers are substantially perpendicular to the bottom panel;

b. a top panel;

c. a bottom side panel foldably attached to the bottom panel and adjacent the top panel, wherein when the carton is lying on the bottom side panel, the containers are arranged in a top layer, a bottom layer and a middle layer;

d. a top side panel foldably attached to the bottom panel;

e. a divider separating the two tiers of containers;

f. an exiting end having a plurality of flaps for closing the exiting end, the plurality of flaps including:

a bottom side flap foldably attached to the bottom side panel;

a top side flap foldably attached to the top side panel;

a bottom end flap foldably attached to the bottom panel, wherein at least one tear line defines a portion of the bottom end flap; and at least one to end flap foldably connected to the top panel;

g. a first and a second tear line extending through the top side panel, wherein the first and second tear lines define part of a dispensing flap, the dispensing flap being removable from the carton to permit a person to grasp the containers in each tier of containers, the first tear line extends into the bottom end flap so that when the dispensing flap is removed, a first projection remains that prevents any of the containers that are adjacent the top side panel, the bottom panel and the exiting end from rolling out of the carton, the second tear line extends into the at least one top end flap so that when the dispensing flap is removed, a second projection remains and prevents any of the containers adjacent the top side panel, the top panel and the exiting end from rolling out of the carton, the first and second tear lines extend towards each other so that a portion of the at least one top end flap and a portion of the bottom end flap are removed when the dispensing flap is removed, and the bottom side flap has sufficient height to prevent any of the containers adjacent the bottom side panel from rolling out of the carton when the dispensing flap is removed; and h. means to close the carton.

16. The carton of claim 15, wherein the top panel includes a race track handle.

17. The carton of claim 16, wherein:

the bottom side flap remains intact when the dispensing flap is removed, and the at least one top end flap comprises an outside top end flap and an inside top end flap.

18. The carton of claim 16, wherein the first and second tear lines converge to a pull tab in the top side panel and extend away from the top side flap.

19. The carton of claim 16, wherein:

the height of the bottom end flap is sufficient to prevent all but the top layer of containers from rolling out when the dispensing flap is removed and the projections prevent the containers in the top layer from rolling out when the dispensing flap is removed.

20. A carton blank, comprising:

a first flap;

a generally rectangular bottom side panel connected to the first flap at a first fold line;

at least one bottom side flap connected to at least one end of the bottom side panel at at least one second fold line;

a generally rectangular bottom panel connected to the bottom side panel at a third fold line;

a bottom end flap connected to the bottom panel at a fourth fold line;

a generally rectangular top side panel connected to the bottom panel at a fifth fold line;

at least one top side flap connected to at least one end of the top side panel at at least one sixth fold line; and a second flap connected to the top side panel at a seventh fold line, wherein the top side panel includes a first tear line that extends obliquely to the fifth fold line, and a second tear line that extends obliquely to the seventh fold line, and wherein the first and second tear lines converge toward one another in the top side panel, and a third tear line extends along and collinear with the fourth fold line and is continuous with the first tear line.

21. The carton blank of claim 20, wherein the first and second tear lines converge at a slit in the top side panel.

22. The carton blank of claim 20, comprising:

a fourth tear line extending from the third tear line obliquely to the fourth fold line.

23. The carton blank of claim 22, comprising:

a first bottom tear line extending from the fourth tear line and terminating at an edge of the bottom end flap, wherein the first bottom tear line includes a portion that is substantially perpendicular to the fourth fold line.

24. The carton blank of claim 23, comprising:

a top end flap connected to the second flap at a fold line, wherein a fifth tear line extends along and collinear with the eighth fold line.

25. The carton blank of claim 24, comprising:

a sixth tear line extending from the fifth tear line obliquely to the eighth fold line; and a second bottom tear line extending from the sixth tear line and terminating at an edge of the top end flap, wherein the second bottom tear line includes a portion that is substantially perpendicular to the eighth fold line.

26. The carton blank of claim 25, wherein:

the fourth tear line extends at an angle from the fourth fold line connecting the bottom panel to the bottom end flap and the sixth tear line extends at substantially the same angle from the eighth fold line; and the third tear line has substantially the same length as the fifth tear line.

27. The carton blank of claim 26, wherein:

the first flap comprise a race track handle; and the second flap comprises a race track handle.

28. The carton blank of claim 22, wherein:

the first flap comprises a race track handle;

the second flap comprises a race track handle; and the at least one bottom side flap comprises two bottom side flaps connected to opposite ends of the bottom side panel.

29. The carton blank of claim 20, wherein the carton blank is made from paperboard.

30. A carton blank, comprising:

a first flap;

a generally rectangular bottom side panel connected to the first flap at a first fold line;

at least one bottom side flap connected to at least one end of the bottom side panel at at least one second fold line;

a generally rectangular bottom panel connected to the bottom side panel at a third fold line;

a bottom end flap connected to the bottom panel at a fourth fold line;

a generally rectangular top side panel connected to the bottom panel at a fifth fold line;

at least one top side flap connected to at least one end of the top side panel at a sixth fold line;

a second flap connected to the top side panel at a seventh fold line; and a plurality of tear lines extending through the blank, wherein the plurality of tear lines define a dispensing flap, and at least one of the tear lines extends along and collinear with the fourth fold line.

31. The carton blank of claim 30, wherein the plurality of tear lines includes:

a tear line that extends obliquely from the fourth fold line;

a tear line extending along and collinear with an eighth fold line connecting the second flap and a top end flap; and a tear line extending obliquely from the eighth fold line.

32. The carton blank of claim 31, wherein the plurality of tear lines includes:

a first tear line and a second tear line extending through the top side panel, wherein the first and second tear lines converge toward one another; and bottom tear lines extending through the top end flap and the bottom end flap.

33. The carton blank of claim 32, wherein:

the tear line that extends obliquely from the fourth fold line extends at an angle; and the tear line extending obliquely from the eighth fold line extends at substantially the same angle.

* * * * *